US005513881A

United States Patent [19]

DiMeglio et al.

[11] Patent Number: 5,513,881

[45] Date of Patent: May 7, 1996

[54] SKATE GUARD

[75] Inventors: Dawn C. DiMeglio, St. Louis, Mo.; Stephen P. Chinninis, Norcross, Ga.

[73] Assignee: Up in the Air, Inc., Alpharetta, Ga.

[21] Appl. No.: 404,083

[22] Filed: Mar. 14, 1995

[51] Int. Cl.[6] ..... A63C 3/12

[52] U.S. Cl. ..... 280/825

[58] Field of Search ..... 280/825, 11.19, 280/809; 30/151, 286, 382, 295

[56] References Cited

U.S. PATENT DOCUMENTS

| | | | |
|---|---|---|---|
| 1,930,810 | 10/1933 | Johnson | 280/825 |
| 2,238,084 | 4/1941 | Tuell et al. . | |
| 3,015,492 | 1/1962 | Kesner et al. | 280/825 |
| 3,338,588 | 8/1967 | Couture | 280/925 |
| 3,583,720 | 6/1971 | Fowlkes . | |
| 4,365,828 | 12/1982 | Hall et al. | 280/825 |
| 4,382,615 | 5/1983 | Gronborg et al. . | |
| 4,382,616 | 5/1983 | Oliveri . | |
| 4,392,674 | 6/1983 | Evon . | |

FOREIGN PATENT DOCUMENTS

| | | | |
|---|---|---|---|
| 1062301 | 9/1979 | Canada | 280/825 |
| 740567 | 9/1943 | Germany . | |
| 954036 | 11/1956 | Germany . | |
| 152976 | 1/1956 | Sweden . | |
| 168276 | 8/1959 | Sweden . | |

*Primary Examiner*—Richard M. Camby

*Attorney, Agent, or Firm*—Beveridge, DeGrandi, Weilacher & Young

[57] ABSTRACT

A skate guard has front and rear pieces with slots for receiving the front and rear portions of a skate runner. A center piece is rigidly connected to the front and rear pieces, and it is formed of a stretchable elastomeric material which biases the front and rear pieces toward each other. The center piece has a downwardly facing tread surface, and it is stiff enough to keep the front and rear pieces substantially longitudinally aligned with each other when the device is not on a skate runner. In a gap between the front and rear pieces, the center piece has a runner-protecting portion which (a) is no higher than the bottom walls of the runner-receiving slots, and (b) lies between two vertical longitudinal planes which include the sidewalls of the runner-receiving slots. Separately molded elastomeric tread pieces are attached to the front and rear pieces. Each tread piece has a horizontal tread portion and a bumper portion which extends around the end of its respective front or rear piece. To facilitate cutting of the front and rear pieces to suitable lengths, pairs of transversely aligned horizontal cutter-positioning grooves are provided on opposite sides of the runner-receiving slots. For further guidance of a cutting tool, outboard vertical grooves are located in a same transverse plane as each pair of cutter-positioning grooves.

19 Claims, 3 Drawing Sheets

FIG. 1
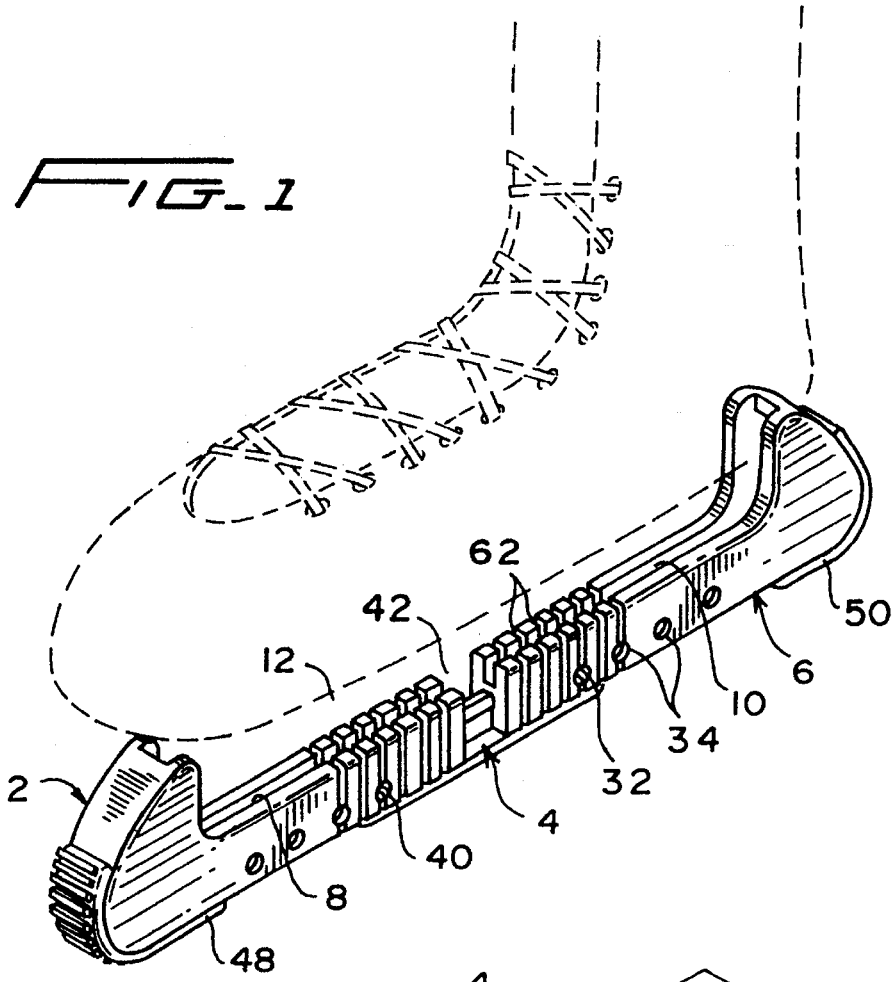
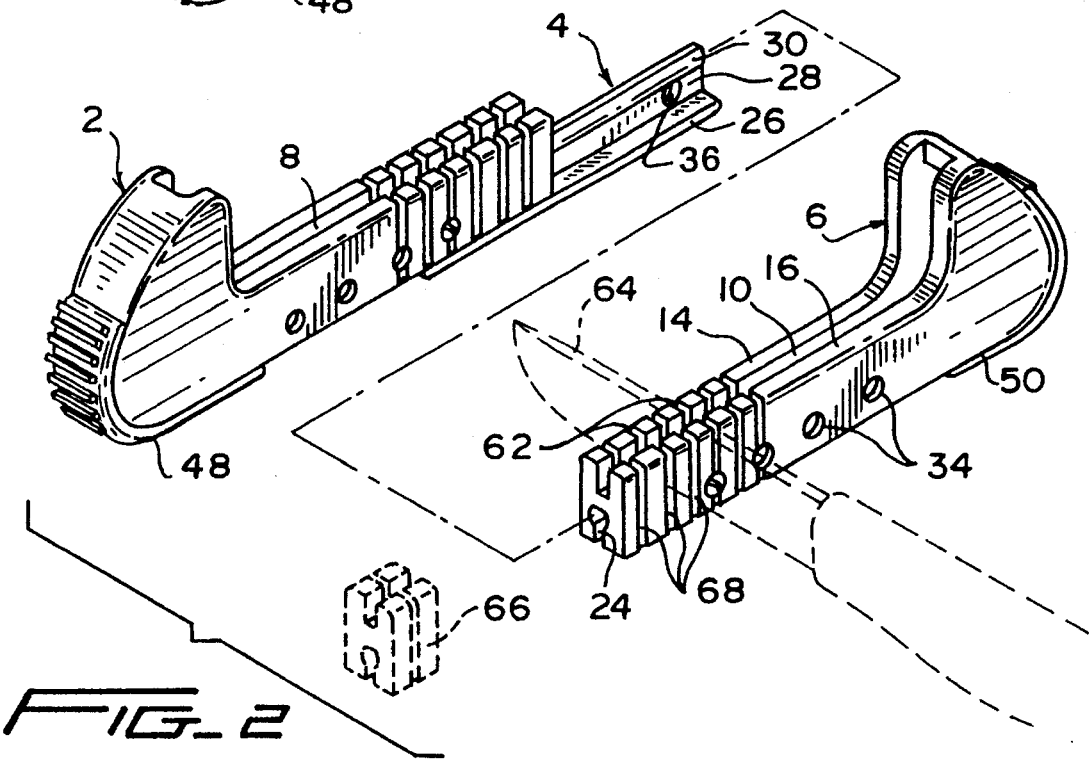
FIG. 2

SKATE GUARD

BACKGROUND

This invention relates to a skate guard which protects a skate runner and enables a skater to walk while wearing skates.

In the past, there have been many different types of skate guards. For many years, the prevalent skate guards for ice skates were one piece molded elastomeric guards which were made and sold in various lengths suited for skate blades of different lengths. These skate guards were relatively expensive to manufacture because different molding dies were required for manufacturing guards of different lengths. The marketing and distribution of these devices were complicated by the fact that various lengths of skate guards had to be available.

In recent years, it has become a practice to mold elastomeric skate guards in two pieces. A front piece is connected to a back piece, and these two pieces are connected together by two longitudinally extending helical tension springs which are mounted on the outboard surfaces of the skate guards. The purchaser cuts the pieces to a length suitable for his or her skate blades, and attaches the tension springs to the two pieces. The springs hold the front and rear pieces together in longitudinal alignment with each other. When these two piece skate guards are mounted on a blade, there is a gap between the first and second pieces. In the area of this gap, there is no protective member directly beneath the bottom surface of the blade. Thus, the blade is exposed to possible damage from objects or materials which enter the gap between the two pieces.

It also has been known to provide a skate guard in which front and rear pieces are connected together by stretchable elastic bands, but these bands are flaccid so that, when the guards are not in use, the front and rear pieces can be arranged in side-by-side positions. These bands do not effectively protect the exposed edge of the blades in the gap between the front and rear pieces.

One object of the present invention is to provide a skate guard which is sold in one length and can be modified by the purchaser so it may be used for various blade lengths. Another object is to provide a guard of the type which has front and rear pieces connected by an elastic center piece which is shaped and positioned to protect the runner from damage. A further object is to provide a guard of the type which has front and rear pieces connected by an elastic center piece, wherein the center piece provides a tread surface. Still another object is to provide a guard of the type which has front and rear pieces connected by an elastic center piece, and in which the center piece is stiff enough to keep the front and rear pieces in longitudinal alignment with each other. Additional objects are to provide a guard which is shaped to facilitate accurate cutting when it is cut to length, and to provide effective and attractive treads and bumpers on the front and rear pieces. Further objects are to provide a skate guard which is durable, attractive, manufactured relatively inexpensively, and can be conveniently configured by the user or a skate shop for use with skate blades of various lengths.

SUMMARY OF THE INVENTION

This invention relates to a skate guard for protecting a skate runner and for enabling a skater to walk while wearing skates. More specifically, it relates to improvements to a known type of skate guard in which an elastic center piece is rigidly connected to front and rear pieces. In these known devices, the front and rear pieces have slots for receiving front and rear portions of a skate runner, and they have internal abutment surfaces which are engageable by the front and rear ends of a skate runner which is positioned in the slots. The center piece is formed of a stretchable elastomeric material which has an elastic memory so that, when under tension, it biases the front and rear pieces toward each other so that the abutment surfaces bear respectively against the front and rear ends of a skate runner in the slots. For purposes of this summary, such a prior skate guard will be referred to as an elastomeric center piece type of skate guard.

In one respect, the invention relates to an elastomeric center piece type of skate guard in which the center piece is located on the longitudinal centerline of the skate guard, and it has a stiffness which is sufficient to maintain the front and rear pieces substantially longitudinally aligned with each other when the skate guard is not on a skate runner.

In another respect, the invention relates to an elastic center piece type of skate guard in which the center piece has a downwardly facing tread surface for contacting a surface on which a skater walks.

The invention, from another perspective, involves an elastic center piece type of skate guard in which the center piece is an obstacle which protects the lower regions of a skate runner. The center piece has a runner-protecting portion which lies between two vertical longitudinal planes which include the vertical side walls of the runner-receiving slots, and the runner-protecting portion is at an elevation which is no higher than the bottom walls of the runner-receiving slots.

In still another respect, the invention relates to an elastic center piece type of skate guard which has first and second tread piece of elastomeric material which are formed separately from the front and rear pieces, and are attached respectively to the front and rear pieces. Each of these tread pieces has a tread portion and a bumper portion. The tread portions lie beneath the respective front and rear pieces to contact a surface on which a skater walks; and, the front and rear bumper portions extend around the respective front and rear surfaces of the front and rear pieces to protect their front and rear surfaces.

In another respect, the invention relates to an elastic center piece type of skate guard which is constructed to facilitate precise cutting of the pieces to suitable lengths. In this regard, cutter-positioning grooves are formed in the upper surfaces of the longitudinally extending upright walls which lie on opposite sides of the runner-receiving slots of the front and rear pieces. These grooves are arranged in pairs which are transversely aligned with each other to receive and guide a cutting tool which is used to cut the piece to a selected length. Preferably, each of the upright walls has an outboard surface provided with vertical grooves for providing additional guidance for a cutting tool. Two such vertical grooves are located in a same transverse plane as each pair of the cutter-positioning grooves.

BRIEF DESCRIPTION OF THE DRAWINGS

FIG. 1 is a perspective view of a first embodiment of a skate guard according to the invention, also showing the skate in broken lines.

FIG. 2 is a perspective view showing the device of FIG. 1, partially disassembled and being configured to shorten its length.

DETAILED DESCRIPTION

Figures 3, 4, 5, 6:
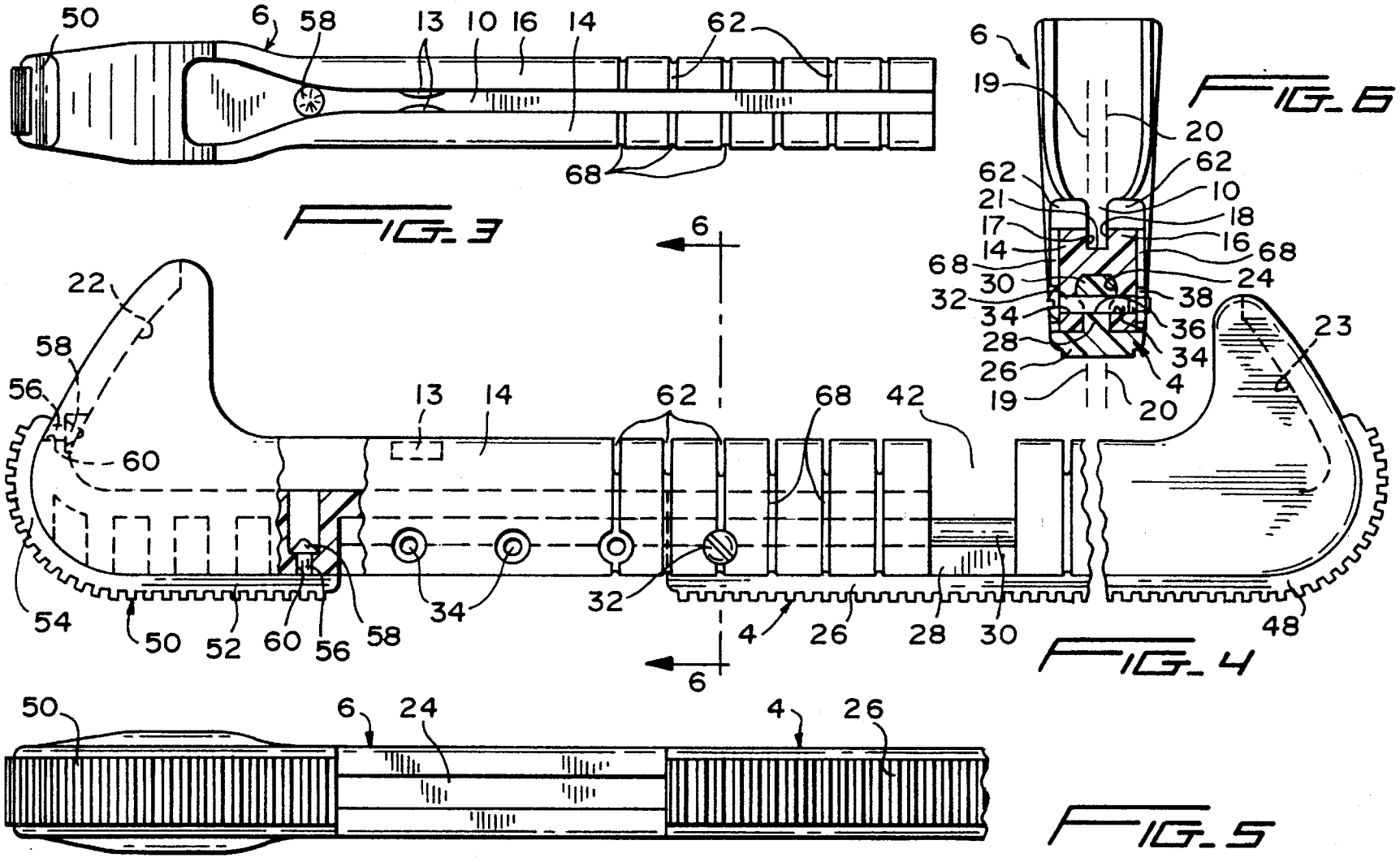
FIG. 3 is a top view of the rear piece of the skate guard of FIG. 1.
FIG. 4 is a fragmentary side view of the skate guard of FIG. 1.
FIG. 5 is a fragmentary bottom view of the skate guard of FIG. 1.
FIG. 6 is a transverse sectional view of the skate guard of FIG. 1, as seen along the line 6—6 in FIG. 4.

Referring to FIG. 1, it will be seen that a skate guard according to the invention is formed of a front piece 2, a center piece 4, and a rear piece 6. The center piece 4 connects the front piece 2 to the rear piece 6. The front and rear pieces 2 and 6 have slots 8 and 10 which receive the blade 12 of an ice skate. A front portion of the skate blade fits into the slot 8, and a rear portion of the blade fits into the slot 10. Integral projections extend into the slots 8 and 10 to apply friction which facilitates the task of placing the skate guard on a skate blade. Two such projections 13 are shown in FIG. 3.

The cross section of the rear piece 6, shown in FIG. 6, includes two longitudinally extending upright walls 14 and 16 which lie on opposite sides of the slot 10. The inboard surfaces of these walls 14 and 16 and the sides 17 and 18 of the slot 10 lie in vertical longitudinal planes 19 and 20. The slot 10 has a bottom 21 and an abutment surface 22 (FIG. 3) which is engaged by the rear end of the skate blade 12. The shape of the front piece 2 is essentially the same as that of the rear piece 6 but, as shown in FIG. 4, the height of the front abutment surface 23 is slightly less than that of the rear abutment surface 22.

FIG. 6 also shows a lower slot 24 which extends longitudinally in the rear piece 6. Thus, as shown in FIG. 2, the cross section of the rear piece 6 is H-shaped. The center piece 4 fits telescopically into the lower slot 24 and into the corresponding lower slot in the front piece 2.

As shown in FIG. 6, the cross section of the center piece 4 is in the shape of an inverted "T." It has a lower tread portion 26, an upright intermediate portion 28, and an enlarged upper portion 30. The cross sectional shapes of the lower slots 24 in the front and rear pieces 2 and 6 correspond to the cross sectional shapes of the intermediate and upper portions 28 and 30 of the center piece 4. As shown in FIG. 6, the center piece 4 is rigidly connected to the rear piece 6 by a bolt 32 which extends through a pair of circular holes 34 in the rear piece 6 and a circular hole 36 in the center piece 4. A nut 38 retains the bolt on the device. In a similar manner, a bolt 40 (FIG. 1) connects the center piece 4 to the front piece 2. Four sets of these holes 34 are provided in the pieces 2 and 6 so that suitable holes will be available, even after the pieces 2 have been shortened by cutting as will be subsequently described.

The center piece 4 is made of elastomeric material which is extensible and resilient, so it can be stretched to allow the length of the skate guard to fit over a skate blade 12. When the center piece 4 is under tension, it biases the front and rear pieces 2 and 6 toward each other, causing parts of the abutment surfaces 22 and 23 to bear against the front and rear ends of a skate blade 12 in the skate guard.

The center piece 4 is sufficiently stiff to keep the front and rear pieces 2 and 6 in longitudinal alignment with each other, even when the guard is removed from the skate runner 12. This stiffness is attributable to the physical properties of the elastomeric material, and to the cross sectional shape of the center piece 4. As shown in FIG. 6, this shape has a substantial moment of inertia about both vertical and horizontal axes.

An important function of the center piece 4 is to protect the skate runner in the gap 42 between the front and rear pieces 2 and 6. This gap is shown in FIGS. 1 and 4. FIG. 6 shows a portion of the center piece 4(*a*) lies between the two vertical longitudinal planes 19 and 20 which include the sides 17 and 18 of the slot 10, and (*b*) is no higher than the bottom 21 of the slot 10. Thus, the center piece 4 is an obstacle which protects the lower regions of the skate runner 12 in the gap between the front and rear pieces 2 and 6.

Separate front and rear tread members 48 and 50 formed of elastomeric material are connected to the front and rear pieces 2 and 6. As shown in FIG. 3, the tread member 50 has a horizontal tread portion 52 and a bumper portion 54 which extends around the rear surface of the rear piece 6. The front tread member 48 has an identical size and shape, and it is mounted similarly on the front piece 2 of the skate guard.

The tread members are attached to the front and rear pieces 2 and 6 in a manner best shown in FIG. 4. The tread member 50 has a pair of cylindrical posts 56 with conical heads 58. These heads 58 are forcibly inserted through holes 60 in the piece 6 until they reach the illustrated positions where the flat annular surfaces of the heads 58 engage annular areas on the interior of the piece 6 in order to retain the tread member in position.

The skate guard is cut by the user to a suitable length as shown in FIG. 2. The locations of the cuts are precisely determined by providing both pieces 2 and 6 with laterally aligned pairs of transverse horizontal cutter-positioning grooves 62. As shown in FIGS. 1 and 6, six pairs of these grooves are formed in the upper surfaces of the upright longitudinal walls 14, 16 which lie on opposite sides of the runner-receiving slot 10. The grooves 62 on opposite sides of each slot 8 and 10 are transversely aligned with each other. FIG. 1 shows a knife blade 64 positioned in a pair of these grooves, in preparation for cutting the piece to a selected length. When the cut is completed, a piece shown in broken lines at 66 will have been removed from the front piece 2.

To provide even greater accuracy during the cutting procedure, vertical grooves 68 are formed in the outboard surfaces of the walls 14, 16. As can be seen in FIG. 6, two of the vertical grooves 68 lie in a same transverse plane as two of the horizontal grooves 62. This plane, of course, is the plane of the section line 6—6 in FIG. 3.

Preferably, a purchaser is provided with a chart which specifies where the front and rear pieces 2 and 6 should be cut in order to arrive at a length which is suitable for a particular runner length. Alphabetical markings are provided on the front and rear pieces 2 and 6 to distinguish the pairs of grooves from each other. For example, the letter "A" is molded into the pieces to indicate the first groove pair for minimum shortening, and the letter "F" is used for identifying the sixth groove pair for maximum shortening.

Figure 9:
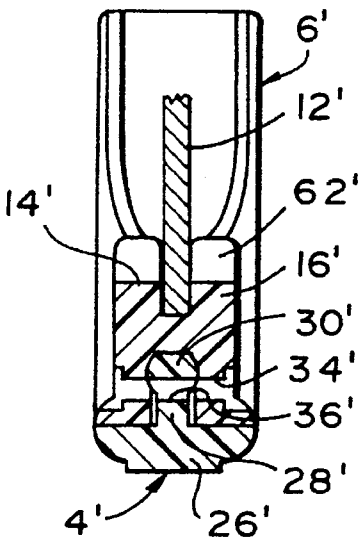
FIG. 9 is a transverse sectional view of the second embodiment as seen along the line 9—9 in FIG. 8.
Figure 7:
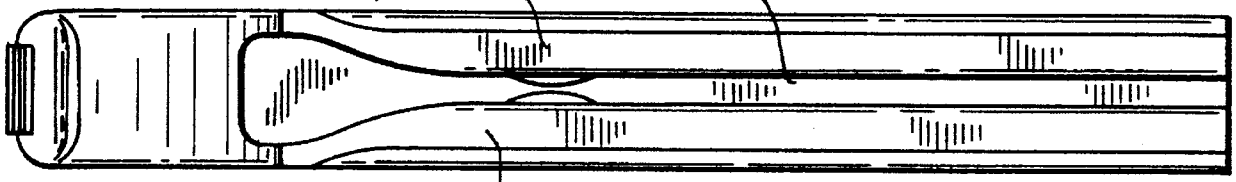
FIG. 7 is a top view of the rear piece of a second embodiment of the invention.
Figure 8:
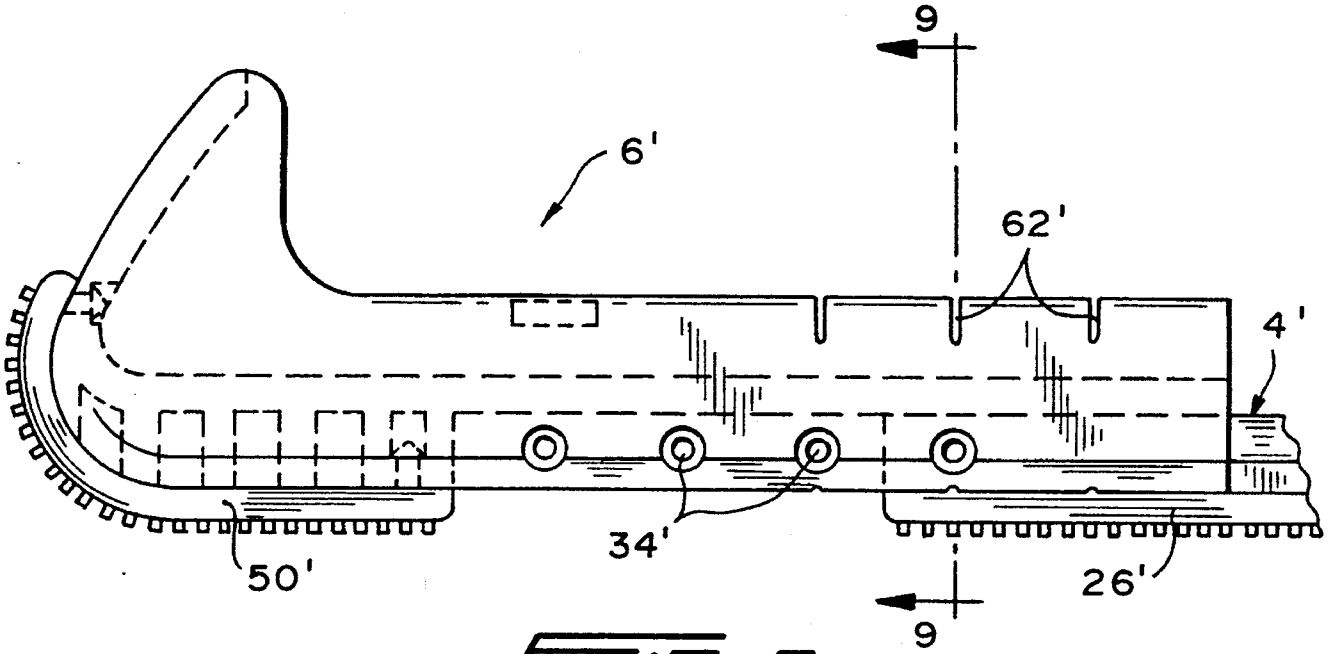
FIG. 8 is a side view of the second embodiment, showing the entire rear piece and a portion of the center piece.

A second embodiment of the device is shown in FIGS. 7–9. This version is similar to the embodiment shown in FIGS. 1–6, but it does not have vertical grooves in the outboard walls of the front and rear pieces. In FIGS. 7–9, the same reference numerals have been used as in FIGS. 1–6, supplemented by prime markings to indicate that they identify elements of this second embodiment of the invention.

The elastomeric pieces of the skate guard are molded from suitable rubbers or synthetic organic polymers. The front and rear pieces 2 and 6 are made of substantially unstretchable materials and, as previously mentioned, the center piece 4 is made of a stretchable material which has an elastic memory so that it will bias the front and rear pieces 2 and 6 toward each other. A suitable material for the center piece 4 is a thermoplastic rubber compound sold under the trademark KRATON® G. It has a hardness (Durometer/Shore) of $13_A$–$62_D$, a tensile strength of 100–3000 psi and an elongation of 20–1200%. KRATON® is a registered trademark of Shell Chemical Company, and this product is available from GLS Plastics, Cary, Ill. 60013.

To enhance the appearance of the device, the front and rear pieces 2 and 6 may be made of brightly colored material. A number of distinctive colors may be provided. The front and rear pieces can be the same color, or they can be different colors. Suitable colors are red, blue, yellow, purple, teal, and magenta. The center piece 4 and the tread pieces are preferably of a neutral color such as black, but bright colors may also be used for these components.

From the foregoing, the manner of manufacturing, distributing and using a skate guard according to this invention will be easily understood. The elastomer pieces are molded, initially assembled, and shipped in a condition so that all units have the same length. The purchaser or a skate shop then configures the skate guards to the lengths which are applicable to the skate blades on which they will be used. For example, a purchaser will ascertain the length of his or her skate blades, and refer to a table which is provided to determine where (grooves "A" for example) the front and rear pieces 2 and 6 should be cut to arrive at a suitable length. Then, a knife blade is positioned as shown at 64 in FIG. 2, where it rests in a pair of transversely aligned slots 62 on the opposite upright walls 14, 16. The knife is forced down and guided so that the blade 64 will follow the vertical grooves 68. Equal amounts are cut from both the front and rear pieces 2 and 6. The opposite ends of the center piece 4 are then telescopically inserted in equal lengths into the slots 24 of the front and rear pieces 2 and 6. The bolt openings 36 in the center piece 4 are aligned with the bolt openings 34 in the respective front and rear pieces 2 and 6. The bolts 32 are inserted through the aligned openings and the nuts 38 are applied and tightened so that the front, center, and rear pieces 2, 4 and 6 are connected together.

During normal use, the physical properties and shape of the center piece 4 are such that it will keep the front and rear pieces 2 and 6 substantially in longitudinal alignment with each other. Since the center piece 4 is stretchable, it is possible to pull the front and rear pieces 2 and 6 apart until the skate blade 12 will fit into the slots 8 and 10. The resilience of the center piece 4 will then bias the front and rear pieces 2 and 6 toward each other until the abutment surfaces 22 and 23 bear against the front and rear ends of the skate blade. As shown in FIG. 1, the center piece 4 will lie directly beneath the blade 12 in the gap 42 between the front and rear pieces 2 and 6, thus reducing the risk that any object or material will come into contact with the edges of the skate blade 12.

The skate guard of the invention is intended primarily for use in connection with ice skates. However, its use is not limited in this regard. If properly dimensioned, skate guards according to the invention can be used on a variety of runners including ice skate blades and the wheels of in-line and other roller skates.

Persons familiar with the field of this invention will recognize that the invention may take many forms other than the embodiments disclosed in this specification. Therefore, it is emphasized that the invention is not limited only to the disclosed embodiments but is embracing of a variety of modifications thereof and improvements thereto which fall within the spirit of the following claims.

We claim:

1. A skate guard for protecting a skate runner and for enabling a skater to walk while wearing skates, said skate guard comprising, a front piece, a rear piece, and an elastic center piece;

said front piece having a front surface, a runner-receiving slot for receiving a front portion of a skate runner, and an internal abutment surface which is engageable by a front end of a skate runner which is positioned in said slot;

said rear piece having a rear surface, a runner-receiving slot for receiving rear portion of a skate runner, and an internal abutment surface which is engageable by a rear end of a skate runner which is positioned in said slot;

said elastic center piece being rigidly connected to said front piece and to said rear piece, said center piece being formed of a stretchable elastomeric material which has an elastic memory so that, when under tension, it biases the front and rear pieces toward each other so that said abutment surfaces bear respectively against front and rear ends of a skate runner in said runner-receiving slots;

said elastic center piece having a stiffness which is sufficient to maintain the front and rear pieces substantially longitudinally aligned with each other when the skate guard is not on a skate runner;

said center piece having a downwardly facing tread surface for contacting a surface on which a skater walks;

said front and rear pieces being longitudinally spaced from each other with a gap therebetween, said runner-receiving slots in the front and rear pieces each having a horizontal bottom wall and two vertical side walls, said center piece extending longitudinally across said gap, said center piece having a runner-protecting portion lying between two vertical longitudinal planes which include said side walls of said runner-receiving slot, said runner-protecting portion being no higher than the bottom walls of said runner-receiving slots, whereby said center piece is an obstacle which protects lower regions of a skate runner;

a first tread piece of elastomeric material which is formed separately from said front piece and is attached to said front piece, said first tread piece having a tread portion and a front bumper portion, said tread portion lying beneath said front piece to contact a surface on which a skater walks, said front bumper portion extending around a front surface of the front piece to protect the front surface of said front piece;

a second tread piece of elastomeric material which is formed separately from said rear piece and is attached to said rear piece, said second tread piece having a tread portion and a rear bumper portion, said tread portion of said second tread piece lying beneath said rear piece to contact a surface on which a skater walks, said rear bumper portion extending around a rear surface of the rear piece to protect the rear surface of the rear piece;

said front and rear pieces each having two longitudinally extending upright walls which lie on opposite sides of the runner-receiving slots, each of said upright walls having an upper surface provided with horizontal cutter-positioning grooves, said cutter-positioning grooves being arranged in pairs which are transversely aligned with each other to receive and guide a cutting tool which cuts the respective piece to a selected length, each of said upright walls having an outboard surface provided with vertical grooves for providing additional guidance for a cutting tool, two of said vertical grooves being located in a same transverse plane as each pair of said cutter-positioning grooves.

2. A skate guard for protecting a skate runner and for enabling a skater to walk while wearing skates, said skate guard comprising, a front piece, a rear piece, and an elastic center piece;

said center piece being formed of a material which is different from that of the front and rear pieces;

said front piece being made of a material which is substantially unstretchable and has a front surface, a runner-receiving slot for receiving a front portion of a skate runner, and an internal abutment surface which is engageable by a front end of a skate runner which is positioned in said slot, said front piece having a longitudinal recess for receiving a front portion of the center piece;

said rear piece being made of a material which is substantially unstretchable and has a rear surface, a runner-receiving slot for receiving a rear portion of a skate runner, and an internal abutment surface which is engageable by a rear end of a skate runner which is positioned in said slot, said rear piece having a longitudinal recess for receiving a rear portion of the center piece;

said elastic center piece having a front portion which is inserted in said longitudinal recess of the front piece and a rear portion which is inserted in said longitudinal recess of the rear piece;

said elastic center piece being made of a material which is stretchable, said elastic center piece being rigidly connected to said front piece and to said rear piece, said center piece being formed of an elastomeric material which has an elastic memory so that, when under tension, it biases the front and rear pieces toward each other so that said abutment surfaces bear respectively against front and rear ends of a skate runner in said runner-receiving slots;

said elastic center piece having a stiffness which is sufficient to maintain the front and rear pieces substantially longitudinally aligned with each other when the skate guard is not on a skate runner.

3. A skate guard for protecting a skate runner and for enabling a skater to walk while wearing skates, said skate guard comprising, a front piece, a rear piece, and an elastic center piece;

said center piece being formed of a material which is different from that of the front and rear pieces;

said front piece being made of a material which is substantially unstretchable and has a front surface, a runner-receiving slot for receiving a front portion of a skate runner, and an internal abutment surface which is engageable by a front end of a skate runner which is positioned in said slot, said front piece having a longitudinal recess for receiving a front portion of the center piece.;

said rear piece being made of a material which is substantially unstretchable and has a rear surface, a runner-receiving slot for receiving a rear portion of a skate runner, and an internal abutment surface which is engageable by a rear end of a skate runner which is positioned in said slot, said rear piece having a longitudinal recess for receiving a rear portion of the center piece;

said elastic center piece having a front portion which is inserted in said longitudinal recess of the front piece and a rear portion which is inserted in said longitudinal recess of the rear piece;

said elastic center piece being made of a material which is stretchable, said elastic center piece being rigidly connected to said front piece and to said rear piece, said center piece being formed of an elastomeric material which has an elastic memory so that, when under tension, it biases the front and rear pieces toward each other so that said abutment surfaces bear respectively against front and rear ends of a skate runner in said runner-receiving slots;

said center piece having a downwardly facing tread surface for contacting a surface on which a skater walks.

4. A skate guard for protecting a skate runner and for enabling a skater to walk while wearing skates, said skate guard comprising, a front piece, a rear piece, and an elastic center piece;

said center piece being formed of a material which is different from that of the front and rear pieces;

said front piece being made of a material which is substantially unstretchable and has a front surface, a runner-receiving slot for receiving a front portion of a skate runner, and an internal abutment surface which is engageable by a front end of a skate runner which is positioned in said slot, said front piece having a longitudinal recess for receiving a front portion of the center piece;

said rear piece being made of a material which is substantially unstretchable and has a rear surface, a runner-receiving slot for receiving a rear portion of a skate runner, and an internal abutment surface which is engageable by a rear end of a skate runner which is positioned in said slot, said rear piece having a longitudinal recess for receiving a rear portion of the center piece;

said elastic center piece having a front portion which is inserted in said longitudinal recess of the front piece and a rear portion which is inserted in said longitudinal recess of the rear piece;

said elastic center piece being made of a material which is stretchable, said elastic center piece being rigidly connected to said front piece and to said rear piece, said center piece being formed of an elastomeric material which has an elastic memory so that, when under tension, it biases the front and rear pieces toward each other so that said abutment surfaces bear respectively against front and rear ends of a skate runner in said runner-receiving slots;

said front and rear pieces being longitudinally spaced from each other with a gap therebetween, said runner-receiving slots in the front and rear pieces each having a horizontal bottom wall and two vertical side walls, said center piece extending longitudinally across said gap, said center piece having a runner-protecting portion lying between two vertical longitudinal planes which include said side walls of said runner-receiving slot, said runner-protecting portion being no higher than the bottom walls of said runner-receiving slots, whereby said center piece is an obstacle which protects lower regions of a skate runner.

5. A skate guard for protecting a skate runner and for enabling a skater to walk while wearing skates, said skate guard comprising, a front piece, a rear piece, and an elastic center piece;

said front piece having a front surface, a runner-receiving slot for receiving a front portion of a skate runner, and an internal abutment surface which is engageable by a front end of a skate runner which is positioned in said slot;

said rear piece having a rear surface, a runner-receiving slot for receiving rear portion of a skate runner, and an internal abutment surface which is engageable by a rear end of a skate runner which is positioned in said slot;

said elastic center piece being rigidly connected to said front piece and to said rear piece, said center piece being formed of a stretchable elastomeric material which has an elastic memory so that, when under tension, it biases the front and rear pieces toward each other so that said abutment surfaces bear respectively against front and rear ends of a skate runner in said runner-receiving slots;

a first tread piece of elastomeric material which is formed separately from said front piece and is attached to said front piece, said first tread piece having a tread portion and a front bumper portion, said tread portion lying beneath said front piece to contact a surface on which a skater walks, said front bumper portion extending around a front surface of the front piece to protect the front surface of said front piece; and, a second tread piece of elastomeric material which is formed separately from said rear piece and is attached to said rear piece, said second tread piece having a tread portion and a rear bumper portion, said tread portion of said second tread piece lying beneath said rear piece to contact a surface on which a skater walks, said rear bumper portion extending around a rear surface of the rear piece to protect the rear surface of the rear piece.

6. A skate guard for protecting a skate runner and for enabling a skater to walk while wearing skates, said skate guard comprising, a front piece, a rear piece, and an elastic center piece;

said front piece having a front surface, a runner-receiving slot for receiving a front portion of a skate runner, and an internal abutment surface which is engageable by a front end of a skate runner which is positioned in said slot;

said rear piece having a rear surface, a runner-receiving slot for receiving rear portion of a skate runner, and an internal abutment surface which is engageable by a rear end of a skate runner which is positioned in said slot;

said elastic center piece being rigidly connected to said front piece and to said rear piece, said center piece being formed of a stretchable elastomeric material which has an elastic memory so that, when under tension, it biases the front and rear pieces toward each other so that said abutment surfaces bear respectively against front and rear ends of a skate runner in said runner-receiving slots;

said elastic center piece having a stiffness which is sufficient to maintain the front and rear pieces substantially longitudinally aligned with each other when the skate guard is not on a skate runner;

said front and rear pieces each having two longitudinally extending upright walls which lie on opposite sides of the runner-receiving slots, each of said upright walls having an upper surface provided with horizontal cutter-positioning grooves, said cutter-positioning grooves being arranged in pairs which are transversely aligned with each other to receive and guide a cutting tool which cuts the respective piece to a selected length.

7. A skate guard according to claim 6 wherein each of said upright walls has an outboard surface provided with vertical grooves for providing additional guidance for a cutting tool, two of said vertical grooves being located in a same transverse plane as each pair of said cutter-positioning grooves.

8. A skate guard according to claim 2, wherein horizontal transverse holes are provided in the front, center, and rear pieces; a fastener extending transversely through aligned holes in the front piece and center piece to connect the center piece to the front piece; and, another fastener extending transversely through aligned holes in the rear piece and center piece to connect the center piece to the rear piece.

9. A skate guard according to claim 8, wherein the front piece and the rear piece each have a plurality of sets of said holes, said sets being longitudinally spaced from each other.

10. A skate guard according to claim 3, wherein horizontal transverse holes are provided in the front, center, and rear pieces; a fastener extending transversely through aligned holes in the front piece and center piece to connect the center piece to the front piece; and, another fastener extending transversely through aligned holes in the rear piece and center piece to connect the center piece to the rear piece.

11. A skate guard according to claim 10, wherein the front piece and the rear piece each have a plurality of sets of said holes, said sets being longitudinally spaced from each other.

12. A skate guard according to claim 4, wherein horizontal transverse holes are provided in the front, center, and rear pieces; a fastener extending transversely through aligned holes in the front piece and center piece to connect the center piece to the front piece; and, another fastener extending transversely through aligned holes in the rear piece and center piece to connect the center piece to the rear piece.

13. A skate guard according to claim 12, wherein the front piece and the rear piece each have a plurality of sets of said holes, said sets being longitudinally spaced from each other.

14. A skate guard according to claim 5, wherein horizontal transverse holes are provided in the front, center, and rear pieces; a fastener extending transversely through aligned holes in the front piece and center piece to connect the center piece to the front piece; and, another fastener extending transversely through aligned holes in the rear piece and center piece to connect the center piece to the rear piece.

15. A skate guard according to claim 14, wherein the front piece and the rear piece each have a plurality of sets of said holes, said sets being longitudinally spaced from each other.

16. A skate guard according to claim 6, wherein horizontal transverse holes are provided in the front, center, and rear pieces; a fastener extending transversely through aligned holes in the front piece and center piece to connect the center piece to the front piece; and, another fastener extending transversely through aligned holes in the rear piece and center piece to connect the center piece to the rear piece.

17. A skate guard according to claim 16, wherein the front piece and the rear piece each have a plurality of sets of said holes, said sets being longitudinally spaced from each other.

18. A skate guard for protecting a skate runner and for enabling a skater to walk while wearing skates, said skate guard comprising, a front piece, a rear piece, and an elastic center piece;

said center piece being formed of a material which is different from that of the front and rear pieces;

said front piece being made of a material which is substantially unstretchable and has a front surface, a runner-receiving slot for receiving a front portion of a skate runner, and an internal abutment surface which is engageable by a front end of a skate runner which is positioned in said slot, said front piece having a longitudinal recess for receiving a front portion of the center piece;

said rear piece being made of a material which is substantially unstretchable and has a rear surface, a runner-receiving slot for receiving a rear portion of a skate runner, and an internal abutment surface which is engageable by a rear end of a skate runner which is positioned in said slot, said rear piece having a longitudinal recess for receiving a rear portion of the center piece;

said elastic center piece having a front portion which includes a transverse cross sectional shape corresponding to that of said longitudinal recess in the front piece, said front portion being telescopically inserted in said longitudinal recess of the front piece;

said elastic center piece having a rear portion which includes a transverse cross sectional shape corresponding to that of said longitudinal recess in the rear piece, said rear portion being telescopically inserted in said longitudinal recess of the rear piece;

said elastic center piece being made of a material which is stretchable, said elastic center piece being rigidly connected to said front piece and to said rear piece, said center piece being formed of an elastomeric material which has an elastic memory so that, when under tension, it biases the front and rear pieces toward each other so that said abutment surfaces bear respectively against front and rear ends of a skate runner in said runner-receiving slots;

horizontal transverse holes provided in the front, center, and rear pieces; a fastener extending transversely through aligned holes in the front piece and center piece to connect the center piece to the front piece; and, another fastener extending transversely through aligned holes in the rear piece and center piece to connect the center piece to the rear piece.

19. A skate guard according to claim 18, wherein the front piece and the rear piece each have a plurality of sets of said holes, said sets being longitudinally spaced from each other.

* * * * *